US005389062A

United States Patent [19]

Mitchum, Jr.

[11] Patent Number: 5,389,062

[45] Date of Patent: Feb. 14, 1995

[54] INTERCOURSE-FACILITATING THERAPEUTIC FURNITURE

[76] Inventor: John T. Mitchum, Jr., 1705 Birch Trail Cir., Unit S, Chesapeake, Va. 23320

[21] Appl. No.: 956,365

[22] Filed: Oct. 5, 1992

[51] Int. Cl.[6] ..... A61F 5/00

[52] U.S. Cl. ..... 600/38

[58] Field of Search ..... 600/38; 280/226.1, 222; 297/355, 356, 284.3, 284.7, 345; 482/72, 73

[56] References Cited

U.S. PATENT DOCUMENTS

| | | | |
|---|---|---|---|
| 361,530 | 4/1887 | Kramer | 280/226.1 |
| 899,705 | 3/1898 | Hansel | 280/226.1 |
| 907,562 | 12/1908 | Boettcher | 280/222 |
| 942,723 | 12/1909 | Flindall | 297/356 |
| 1,380,893 | 6/1921 | Gebert | 280/222 |
| 1,735,601 | 11/1929 | Curry | 280/222 |
| 1,929,081 | 10/1933 | Serpico | 280/222 |
| 4,099,773 | 7/1978 | Chang . | |
| 4,479,646 | 10/1984 | Chirapozu | 482/72 |
| 4,641,889 | 2/1987 | Miyashita et al. | 297/284.3 |
| 4,699,423 | 10/1987 | Fitzig et al. | 297/245 |
| 4,756,496 | 7/1988 | Hosan | 297/346 |
| 4,805,961 | 2/1989 | Garrod | 297/355 |
| 4,825,855 | 5/1989 | Kundson, Jr. . | |
| 4,923,193 | 5/1990 | Pitzen et al. | 482/72 |
| 4,976,451 | 12/1990 | Kamenov | 280/226.1 |
| 5,069,496 | 12/1991 | Kunh et al. | 297/345 |
| 5,072,929 | 12/1991 | Peterson et al. | 482/72 |
| 5,120,109 | 6/1992 | Rangoni | 297/289.3 |

FOREIGN PATENT DOCUMENTS

| | | | |
|---|---|---|---|
| 145 | of 1910 | United Kingdom | 297/246 |

*Primary Examiner*—Paul J. Hirsch
*Attorney, Agent, or Firm*—Stephen E. Clark

[57] ABSTRACT

Therapeutic furniture for disabled persons adapted to support man and woman partners engaged in intercourse has longitudinally moveable man's seat facing adjustable-position female seat. Male partner is supported by seat with his back in a substantially upright position to relieve stresses on lumbar vertebrae, pelvis and legs. Longitudinal movement of the man's seat is effected by hand operation of a joy stick in mechanical communication with the seat, or, according to a modification of the invention, by actuation of an electric motor in electrical communication with the man's seat. Woman's seat and back are independently adjustable.

10 Claims, 6 Drawing Sheets

INTERCOURSE-FACILITATING THERAPEUTIC FURNITURE

FIELD OF INVENTION

The present invention relates to therapeutic furniture and apparatus. In particular, the present invention relates to intercourse-facilitating therapeutic furniture adapted to accommodate a man and a woman and having a reciprocating support seat.

BACKGROUND

For many persons it is physically very difficult, if not virtually impossible, to have intercourse. For many persons with disabilities it may be physically very painful to either assume a position or provide the necessary movements necessary to have intercourse. For example, male paraplegics; men with back and spine problems; infirmed persons; frail persons; obese persons; and persons with other disabilities, may all find it both difficult and painful to even assume a position for having intercourse. In addition, even after men who have certain physical disabilities have assumed a position to have intercourse, they may be physically unable to move their body as necessary to have intercourse. In many cases, disabilities or frailty of the male partner will preclude the option of his enjoying sex from a passive (i.e. motionless) perspective, as his disabilities (such as an injured spine, etc.) may not allow him to support the weight of his partner upon him.

Various prior apparatus are known for assisting persons during intercourse. Many prior devices aid the positioning of the participants in their direct physical stimulation of one another. U.S. Pat. Nos. 4,825,855 and 4,099,773 are examples of such prior devices. A problem with such prior devices is that they are not adapted for use by physically disabled persons, or, for that matter, most elderly persons. In particular, such prior devices can not be used by persons who have severe back or spine problems, as the use of such prior devices would likely aggravate the participant's disabilities.

Another problem with such prior devices is that they do not provide adequate vertical support for both partners.

Various prior therapeutic apparatus are well known which support disabled persons. Such apparatus include tables, fixed chairs, wheel chairs, etc. A problem with such prior devices is that, in many cases, it is virtually impossible to have intercourse while properly (i.e. therapeutically non-disfunctionally) using such devices.

Another problem with such prior devices is that, in order to have intercourse on (or in) such devices, at least one of the participants must physically move, (eg. back and forth) relative to the other. For many disabled persons, they either do not have the muscle strength in their lower body to make such movements, or they do not have sufficient lumbar support, or they do not have the necessary neurological control in their lower body to make such movements.

OBJECTS

Accordingly, it is a primary object of the present invention to provide therapeutic apparatus which is adapted to support two partners while they are having intercourse.

It is another object of the present invention to provide a device of the character described wherein the two partners are supported facing each other.

It is another object of the present invention to provide a device of the character described wherein the male is supported by a longitudinally moveable seat.

It is another object of the present invention to provide a device of the character described wherein the male may be seated in a generally upright position, so as to reduce stress to his back and spine, particularly the lumbar vertebrae.

It is another object of the present invention to provide a device of the character described wherein the female partner 1s supported at her pelvis and her back.

It is another object of the present invention to provide a device of the character described wherein longitudinal movement of the male partner's seat is controlled by hand-actuation by the male partner or, alternatively, by the female partner.

It is another object of the present invention to provide a modification of the device described wherein longitudinal movement of the male partner is effected by hand-controlled actuation of an electrically powered seat.

Further objects and advantages of my invention will become apparent from a consideration of the drawings and ensuing description thereof.

DRAWINGS

DESCRIPTION

Figure 1:
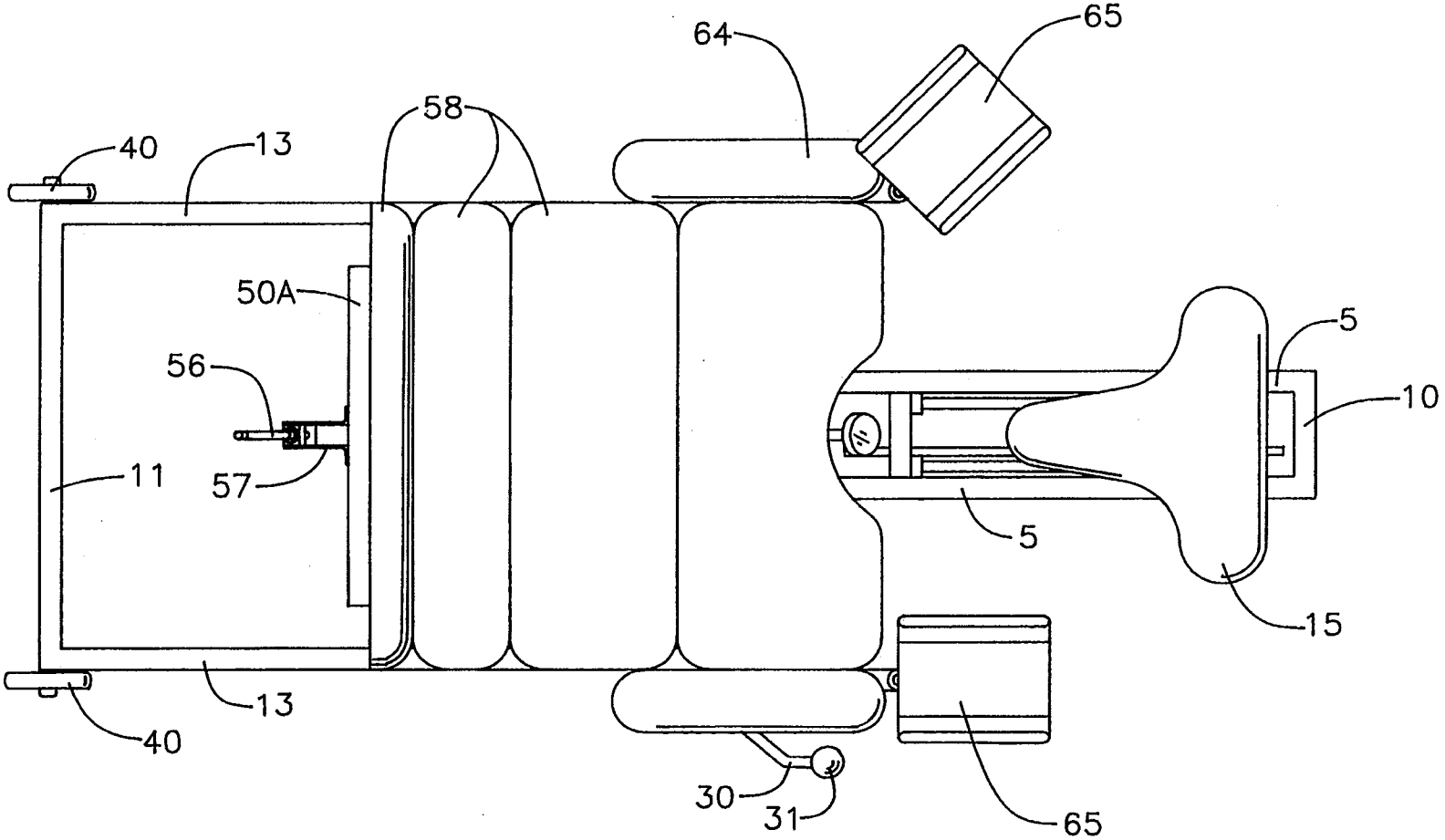
FIG. 1 is a plan view of the preferred embodiment of the present invention.
Figure 2:
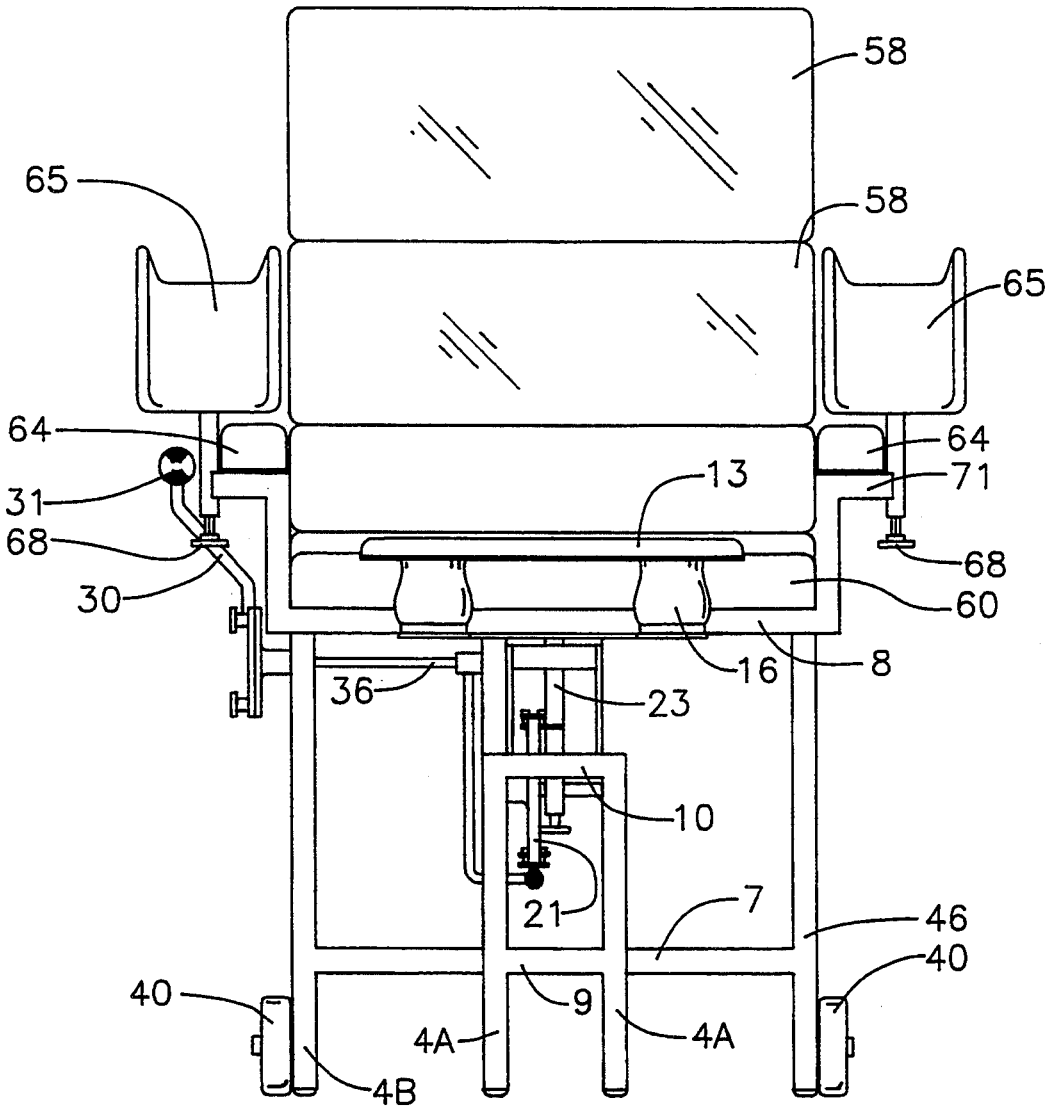
FIG. 2 is a front elevation of the preferred embodiment of the present invention.
Figure 3:
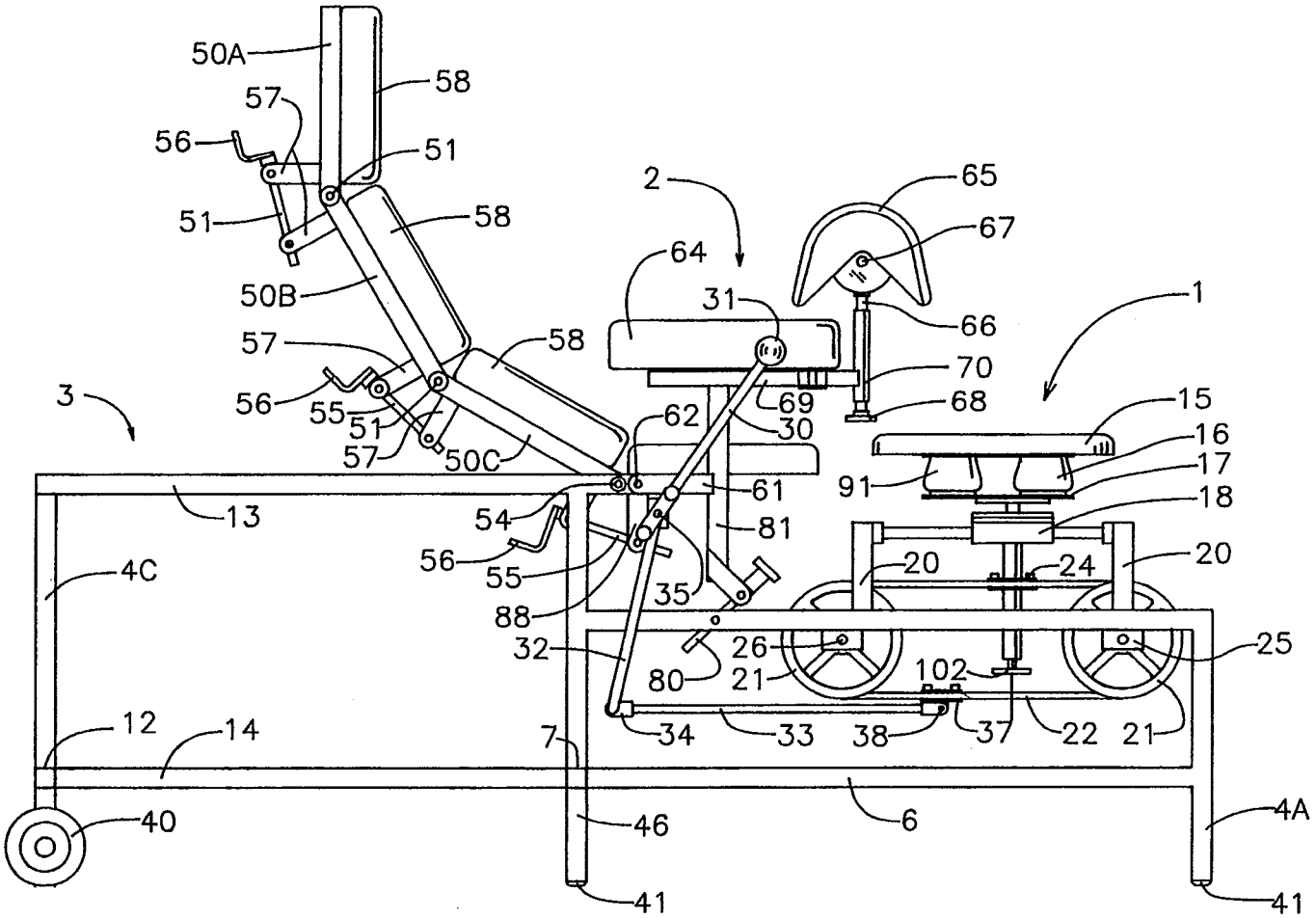
FIG. 3 is a right side elevation of the preferred embodiment of the present invention.

In the preferred embodiment of the invention, a longitudinally moveable male partner's seat (hereinafter "male support", generally designated (1) in the figures) and a longitudinally fixed female partner's seat (hereinafter "female support", generally designated (2) in the figures) are supported upon a frame (generally designated (3) in the figures), Unless stated otherwise, orientation nomenclature throughout this specification conforms to the perspective of the a person operably seated on the male support (1), hence: The "front" of the device is "behind" the female support (2); the "back" of the device is behind the male support (1); and the left and right sides of the device are oriented according to a forward-directed person seated on the male support (1). In addition, it is understood that the present invention is provided with a system of legs by which it the apparatus may stand upright when in operation. Accordingly, in the following disclosure reference to the "height" of various components of the apparatus refer to the distance above a horizontal floor upon which the apparatus may be considered to be standing.

The frame (3) comprises three pairs of fixed legs (4). On each side of the frame (1), a front leg **(4*a*) is attached to a middle leg (4*b*)** with a horizontal, forward side top frame member (5) and a horizontal, forward side bottom frame member (6,) respectively. The two middle legs (4*b*) are secured to each other with a horizontal bottom frame member (7) and a horizontal top frame member (8). The two front legs (4*a*) are attached to each other with a horizontal, front bottom frame member (9) and a horizontal, front top frame member (10). In the preferred embodiment of the invention the two forward side top frame members (5) are spaced apart, measuring approximately 6 inches from outside to outside. This relatively narrow spacing of the two forward side top frame members (5) allows for them to be straddled by a man's legs when he is seated upon the man's seat (15).

Two back legs (4*c*) are attached to each other with a horizontal top frame member (11) and a horizontal bottom frame member (12), respectively. Each back leg (4*c*) is secured to the rest of the frame (3) with a back side top frame member (13) and a back side bottom frame member (14), which extend from the back legs (4*c*) to the horizontal top frame member (8) and the bottom frame member (7), respectively.

In the preferred embodiment of the invention the overall length of the frame (3), as measured from the back legs (4*c*) to the front legs (4*a*) is approximately 59 inches; and the height of the forward side top frame members (5) is approximately 14 inches. The two back legs (4*c*) are provided with wheels (40), so that the apparatus may be readily transported. The bottoms of the middle legs (4*b*) and the front legs (4*a*) are provided with skid resistant feet (41) which help retain the apparatus from moving across the floor during operation. Preferably the frame (3) is constructed of tubular aluminum, but it is within the scope of this invention to use any other common framing materials in the construction of this device.

The male support (1) comprises a cushioned seat (15) which rests upon three adjustable pneumatic supports (16). In the preferred embodiment of the invention the seat (15) is approximately 24 inches high (i.e. above the floor). The three adjustable pneumatic supports (16) are bellow-like in construction and are each provided with pneumatic valves (not shown) so that the air pressure within the pneumatic supports (16) may be adjusted. The pneumatic supports (16) are secured upon the seat support plate (17) which, in turn, is secured on top of an adjustable-height seat support shaft (23). The seat support shaft (23) is rigidly secured to a pair of linear bearings (18) which ride on longitudinally oriented bearing shafts (19), respectively. The seat support shaft (23) is additionally secured (by belt clamp (24)) to belt (22). The belt (22) rides on pulleys (21). Each of pulley (21) freely pivots about a pulley shaft (26) that is supported by a pair of bearings (25). In the preferred embodiment of the invention the pulleys (21) are approximately 6 inch diameter and their centers are spaced approximately 14 inches apart. The bearings (25) are permanently secured to the respective forward side top frame members (5).

A joy stick (30) is pivotally attached to the frame (3) by a joy stick shaft (36) and a pair of bearings (35) which are secured to secured to the frame (3). The joy stick extension (32) is connected to one end of the joy stick actuator (33) by a clevis joint (34), or similar pinned connection. The opposite end of the joy stick actuator (33) is secured to the underside of the pulley belt (22) by a belt clamp (37). In the preferred embodiment of the invention, the joy stick actuator (33) is secured to the belt clamp (37) with a pin-type connection (38).

The female support (2) comprises a multi-panel back rest (50) having a top panel (50*a*), a middle panel (50*b*), and a lower panel (50*c*). Adjacent back rest panels (50*a*), (50*b*) and (50*c*) are pivotally attached to one another by a pinned connection (51); and forward end of the lower back panel (50*c*) is additionally pivotally attached to the frame (3) by a pin-type connection (54) between the lower panel (50*c*) and forward extensions (53) of the back side top frame member on the right and left sides of the apparatus, respectively. A cushion (58) is attached to the "top" side of each of the back rest panels (50*a*), (50*b*) and (50*c*). The angle of incline between adjacent back rest panels may be adjusted by varying the distance between the outboard ends of corresponding pairs of adjustment screw brackets (57) which are rigidly attached to the "bottom" side of each of the back rest panels (50*a*), (50*b*) and (50*c*), respectively. The distance between adjacent pairs of adjustment screw brackets (57) may be adjusted by rotating the appropriate back rest adjustment screw (55) which is threadedly engaged with the respective adjustment screw bracket (57). A handle (56) may be provided on each back rest adjustment screw (55) for facilitating its rotation. A fixed adjustment screw bracket (88) is secured to frame (3) so that the angle of the lower panel (50*c*) (relative to the frame (3) itself) may be adjusted. The multi-panel back rest (50) is preferably the same width as the forward end of the frame (3) (approximately 22 inches), such that when the back rest (50) is in the horizontal position the individual back rest panels (50*a*), (50*b*) and (50*c*) are each supported by the back side top frame members (13). When the multi-panel back rest (5) is in the horizontal position the top of the cushions (58) are preferably approximately 22.5 inches above the floor.

The female support (2) also comprises a seat (60), the underside of which is attached to a seat frame (61). The seat frame is pivotally attached to the forward extension (53) of the back side top frame members by a pin-type connection (62), such that the entire seat (60) and seat frame (61) assembly may pivot up and down together about the rear of the seat frame (61). Upright frame members (63) which are rigidly attached to the seat frame (61) extend above the seat (60) on the left and right sides of the apparatus, respectively. To each upright frame member (63) is attached an arm rest frame member (69) and cushioned arm rest (64). Beyond the rear end of each cushioned arm rest (64) is a padded stirrup (65). The padded stirrup (65) is secured to the frame (3) by a swivel-attached stirrup support bracket (71) which is connected to the arm rest frame (69) and the adjustment sleeve (70). The height of the padded stirrup (65) relative to the arm rest (64) may be controlled by rotating the support post (66) (by adjustment handle (68)), which is in threaded engagement with the stirrup height adjustment sleeve (70). In the preferred embodiment of the invention, the nominal height of the top of the padded stirrup (65) is approximately 33 inches above the floor. The padded stirrup (65) is secured to the stirrup support post (66) by a pin-type connection (67) such that the padded stirrup may freely pivot about a horizontal axis. The angle of incline of the entire seat (60), seat frame (61), upright frame member (63), arm rest (64) and padded stirrup (65) assembly may be adjusted together by the seat adjustment screw (80). The seat adjustment screw (80) is pivotally connected to the lower extension (81) of the seat frame; and is threadedly engaged with a seat adjustment collar (82) which, in turn, is secured to the forward side top frame members (5) on the left and right sides of the apparatus, respectively.

In the preferred embodiment of the invention, the cushions (58) of the multi-panel back rest (50), the cushioned arm rest (64), the padded stirrup (65), the woman's seat (60) and the man's seat (15) are each covered with a vinyl (or similar) material that can be easily cleaned.

OPERATION

In operation a woman takes her position seated upon the female support (2). Prior to boarding the female support (2), the multi-panel back rest (50) may be adjusted to virtually any position that is most comfortable to the woman. As discussed above, by adjusting the back rest adjustment screws (55), the multi-panel back rest (50) can be configured from straight and horizontal, to curved upright. In operation, the woman rests on the seat (60), while the multi-panel back rest (50) supports her upper body. Cushioned arm rests (64) are provided on each side of the apparatus to provide additional support to the woman when desired. Padded stirrups (65) are also provided on each side of the apparatus. In operation, the padded stirrups (65) provide support for the woman's legs. The height of the padded stirrup may be adjusted to the desired position by adjusting the height of the stirrup support post (66). Complete two axis maneuverability of the padded stirrups (65) is provided by the stirrup's pivot connection (67) to the support post (66) and by the support post's (66) rotation within the adjustment sleeve (70). In addition, the swivel-connected stirrup support brackets (71) allow the woman vary the amount she spreads her legs while her legs are supported by the padded stirrups (65).

By adjusting the seat adjustment screw (80), (as discussed above), the angle of the woman's seat (60) can be varied from horizontal up to approximately 30 degrees. As the angle of the woman's seat (60) is adjusted, the cushioned arm rests (64) and the padded stirrups (65) move together with the seat (60). It will be appreciated that by adjusting the angle of the woman's seat (60) (and the cushioned arm rests (64) and padded stirrups (65)), the woman (being seated upon the seat) will be restrained from sliding towards the man's seat (15) when in operation.

It will be appreciated from a review of the above disclosure that the various components of the female support (2) of the present invention may be adjusted to comfortably support women of different sizes and of different physical limitations, in positions suitable for having intercourse.

In operation a man takes his position seated upon the man's seat (15) and facing a woman seated in the woman's seat (60). In the preferred embodiment of the invention the man' seat (15) is supported by three adjustable pneumatic supports (16). The pneumatic supports (16) are of bellows-like construction. The firmness of the pneumatic supports (16) may be adjusted by varying the amount of air pressure inside of the supports (16). Air may be introduced under pressure into the pneumatic supports (16) through a pneumatic valve (91). It will be appreciated that by varying the amount of firmness of the three pneumatic supports (16), the amount of "wiggle" in the man's seat may be controlled. In operation, it is considered desirable to have some "wiggle" in the man's seat (15) which is independent of any movement of the seat support plate (17) or the joy stick (30).

The handle (31) of the joy stick (30) is within reach of a man seated upon the man's seat (15). By alternately pulling or pushing against the joy stick (30), the man can cause the seat (15) and himself to respectively move farther from or closer to the woman seated in the woman's seat (60). When the joy stick handle (31) is pushed "forward", the joy stick (30) pivots about bearing (35), causing the joy stick extension (32) to move "backward", the bottom of the pulley belt (22) to move "backward" and the top of the pulley belt (22) to move "forward". The seat support post (23), being secured to the top of the pulley belt (22), moves "forward", causing linear bearing (18) and the man's seat (15) to move "forward" upon the bearing shafts (19). In the preferred embodiment of the invention, the joy stick actuator (33) is attached to the bottom side of the pulley belt (22), thus causing the man's seat to move "forward" and "backward" when the joy stick is moved "forward" and "backward", respectively. However, it is well understood that the actuator can alternatively be connected to the top side of the pulley belt (22), thus causing the male operator and the man's seat (15) to move towards the woman and the woman's seat (60) when the man pulls "backward" on the joy stick (30).

In the preferred embodiment of the invention the length of the joy stick (30) and the length of the joy stick extension (32) are approximately the same lengths. Accordingly, in the preferred embodiment of the invention there is a 1-to-1 ration between the movement of the joy stick handle (31) and the movement of the man's seat (15). However, it is understood that the present invention can be modified such that the relative lengths of the joy stick (30) and the joy stick extension (32) either greater or less than 1-to-1, thus effecting respectively either a smaller or greater movement of the man's seat (15) when the joy stick handle (31) is moved.

In the preferred embodiment of the invention the man's seat support post (23) and the joy stick actuator (33) are clamped to opposite ends of the top and bottom of the pulley belt, respectively, to maximize the available length of travel of the man' seat (15). In the preferred embodiment of the invention, the forward end of the man's seat (15) is less than 1 inch from the woman's seat (60) when the man's seat (15) is in its forwardmost position.

It will be appreciated from review of the preceding disclosure that the construction of the male support (1) of the present invention, provides for a comfortable seat (15) upon which a man can be seated in an upright position. It will further be appreciated that the entire weight of a man seated upon the male support (1) of the present invention may be carried by the man's seat (15). It is also noted that, since the man's seat (15) is approximately 24 inches high he may comfortably sit on the seat (15) with his feet on the ground, so that his feet may provide support and stability as desired.

It will be appreciated from a review of the preceding disclosure that when a woman and a man are each positioned upon the apparatus in the manner described, and that by the man's operating the joy stick so as to bring him to the woman, they can have intercourse with each other. During intercourse the joy stick can be pushed or pulled as desired to vary the depth of penetration. In addition, limited movement of the man (independent of the joy stick (30) motion) is afforded by the "wiggle" in the man's seat (15) which rests upon pneumatic supports (16).

It will be appreciated that although the above described operation of the device facilitates two person's engaging in intercourse, each person is entirely supported by the apparatus itself, and, significantly, neither partner is required to support the weight of the other. In addition, because the male support (1) of the present invention allows the male partner to sit upright, it will be appreciated that it is possible for a man having upper body disabilities (or other physical handicaps) to comfortably and safely have intercourse while seated upon this device. Similarly, because the female support (2) of the present invention can be adjusted to distribute the weight and to support the female partner in a comfortable position, it is possible for a woman having either upper or lower body disabilities or handicaps to comfortably and safely have intercourse while seated upon this device.

Figure 4:
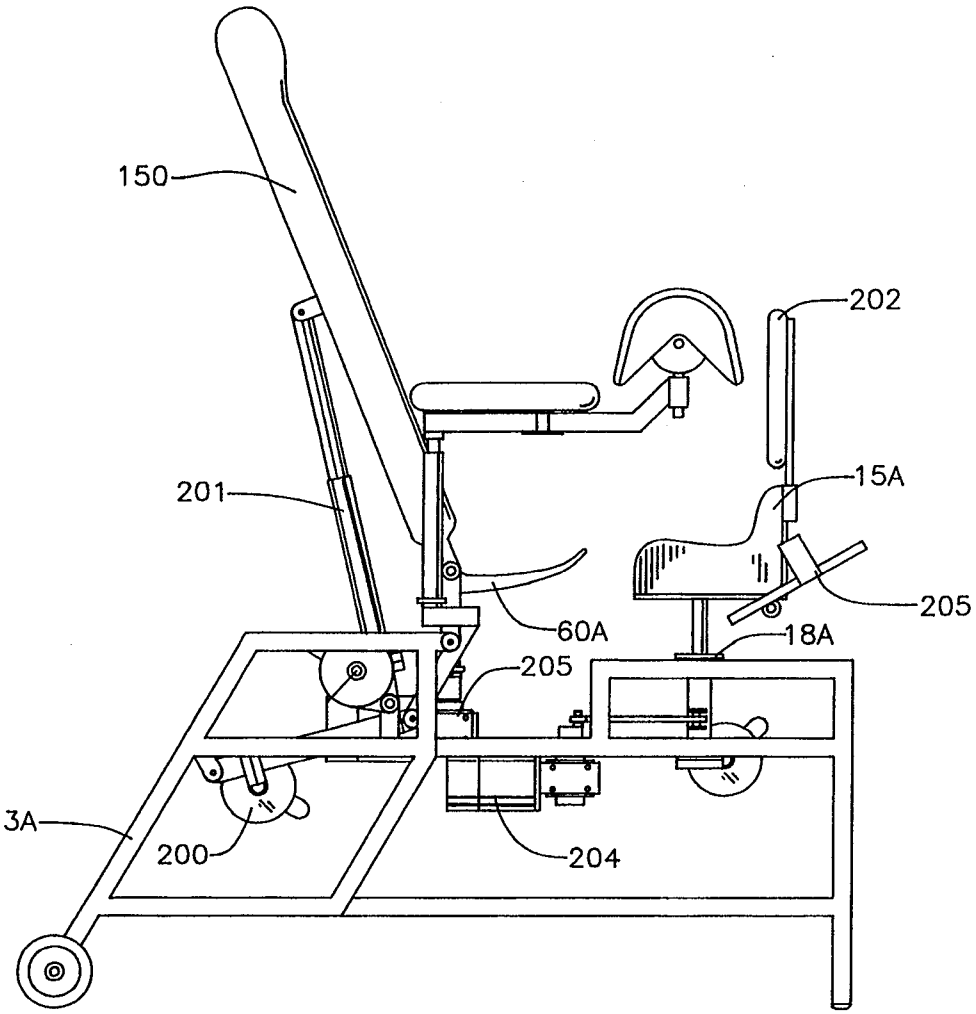
FIG. 4 is a side elevation of a modification of the present invention showing a motorized seat.
Figure 5:
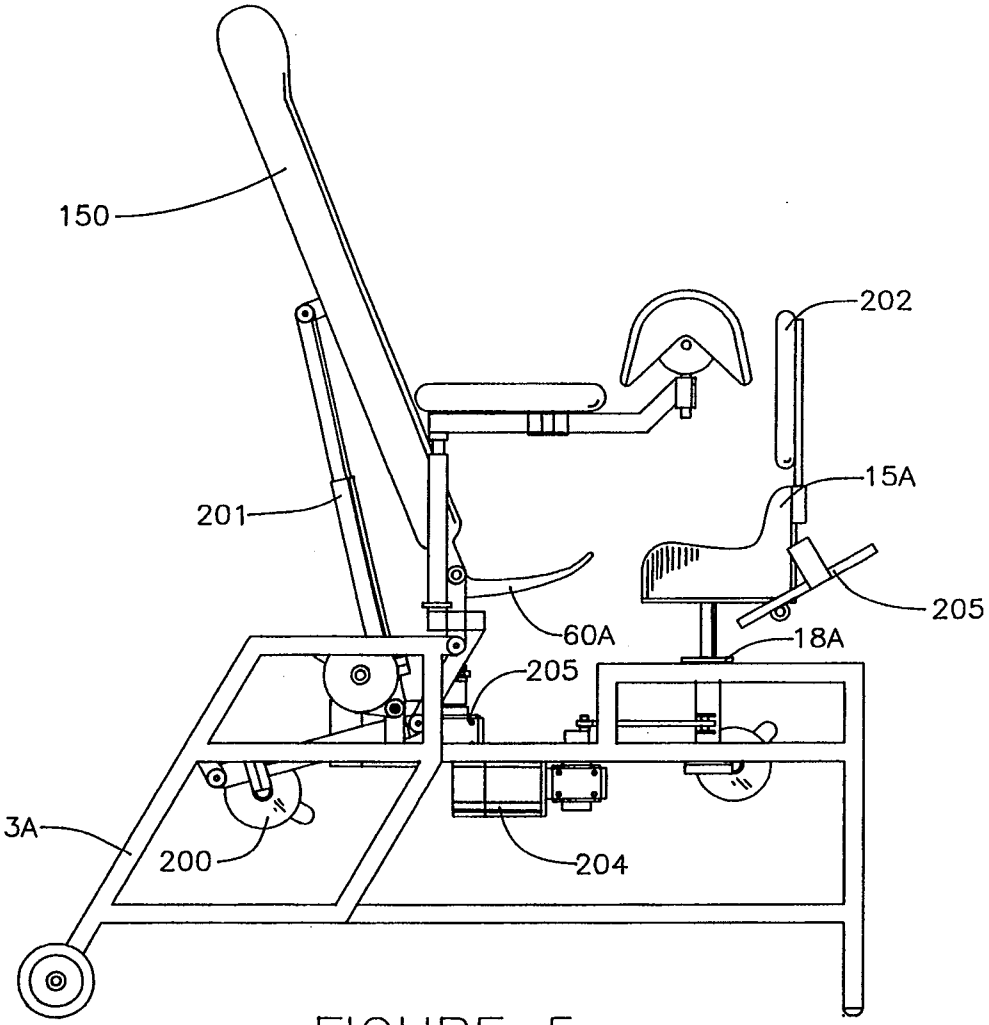
FIG. 5 is a side elevation showing the device of FIG. 4 in use; and, FIG. 6 is a side elevation showing the device of FIG. 5 with the woman's back rest down, and the man's seat in the forward position.
Figure 6:
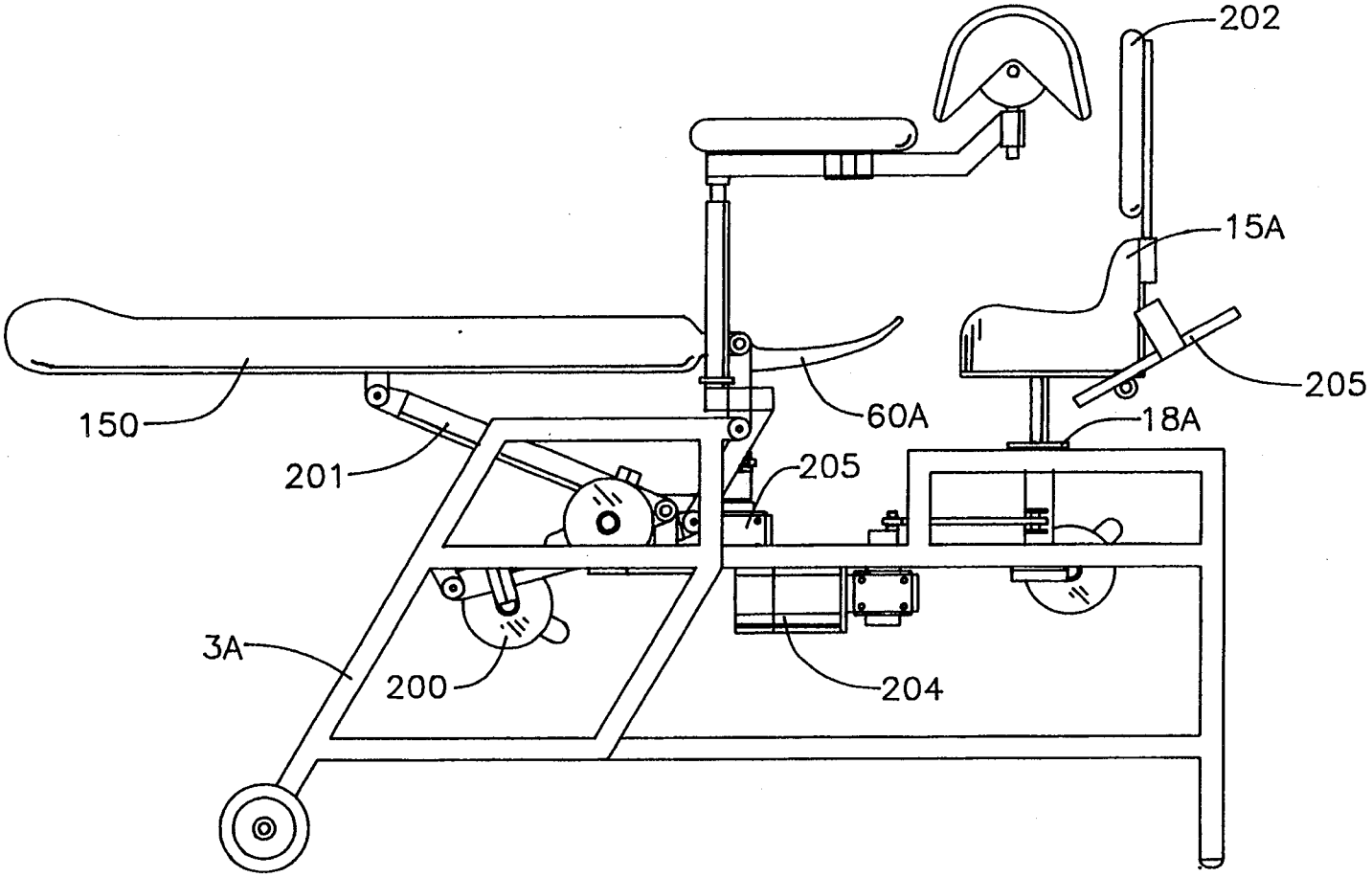

A modified embodiment of the present invention is shown in FIGS. 4–6. In this modification of the invention, the woman's back rest (150) comprises a single elongated back rest. As with the preferred embodiment of the invention, in this modification of the invention the back rest (150) may be positioned from horizontal to nearly upright. In the modified embodiment of the invention an electric linear actuator (200) in communication with a telescopic actuator arm (201) automatically raises or lowers the woman's back rest (150) to the desired angle relative to the apparatus' frame (3*a*). In addition, in the modified embodiment of the invention shown in FIGS. 4–6 the man's seat (15*a*) is provided with a removable back rest (202), and seat belt (203), each of which components (202) and (203) may be desirable for a male operator who has disabled legs. In addition, in this modification of the invention. (FIGS. 4–6), a variable speed electric motor (204) which is in communication with the man's seat (15*a*), causes the male seat (15*a*) to reciprocate approximately 2 inches "forward" and "backward" when engaged. Another modification of the present invention is the incorporation of a variable speed electric motor (205) which is in communication with the woman's seat (60*a*). The variable speed electric motor (205) causes the woman's set (60*a*) to oscillate approximately ¾ inch from side to side. In this modification of the invention the woman's seat (60*a*) rides upon a linear ball bearing whose axis is approximately perpendicular to the longitudinal axis of the frame (3*a*). Another modification of the present invention (as shown in FIGS. 4–6) is the attachment of foot rests (205), on each side of the man's seat (15*a*). The foot rests (205), which are pivotally connected to the man's seat (15*a*) are provided for support of the woman's legs, (and may be used in place of the padded stirrups (65) described above in connection with the preferred embodiment of the invention).

While the above description contains many specificities, these should not be construed as limitations on the scope of the invention, but rather as an exemplification of one preferred embodiment thereof. Many other variations are possible, for example:

A skirt, shroud or fender may be provided around the frame so as to hide the various components of the device from view;

The joy stick (30) may be positioned so that it is within reach of both partners, or within reach of the woman only;

In the motorized modification of the invention, multiple motor controls may be provided for access to both the man and the woman;

A pair of joy sticks (30) may be provided, (one on each side of the frame), rather than just one;

The woman's seat (60) may be supported from the frame so as to provide for approximately 2 inches of lateral (i.e. left-and-right) movement of the seat;

The middle (4*b*) and the front (4*a*) legs may alternatively be provided with locking wheels, rather than skid resistant feet;

Secondary gears or pulleys may be provided (in place of the 1-to-1 pulleys (21)) to either increase or decrease the mechanical advantage between the joy stick (30) and the man's seat (15);

A direct-drive, reduction gear motor may be used in place of pulleys (21) or gears;

The cushioned arm rests (64), the padded stirrups (65) and the woman's seat (60) may be constructed to be independently adjustable (rather than rigidly attached to move together);

The man's seat may be supported by a ball-and-socket type connection and a plurality of vertically directed compression springs in place of the disclosed pneumatic supports (16);

Retractable upright handle bars, secured to the frame (3), may be provided for use by the male operator's use;

The seats (15) and (60) may either be either square, or "bike seat" configurations, or other shapes;

The woman's seat (60) may be constructed with pneumatic supports (16) to provide "wiggle" for the woman's seat (60), and such "wiggle" may alternatively be provided by a motor in communication with the seat;

Pneumatic cushions, pliable foams, springs, fluids, or other means may be constructed beneath either male (15) or female (60) seats to provide "wiggle" to those seats;

The man's seat (17) may be rigidly secured so as to have no "wiggle" independent of the movement of the joy stick (30);

The 11near bearing (18) component may be either ball bearings, or soft metal (i.e. bronze, etc) bushings, or other common means for facilitation reciprocating linear motion of the man's seat (15);

The height of the man's seat may be adjustable, using any common seat height adjustment methods, including both manual and automatic (i.e. motorized) means; and, The man's seat (15) can be provided with a back rest;

Accordingly, the scope of the invention should be determined not by the embodiment illustrated, but by the appended claims and their legal equivalents.

I claim:

1. A furniture apparatus, comprising:

a rigid frame member adapted to stand upright on a floor, said rigid frame member having a first end and a second end and a longitudinal axis therebetween;

means for supporting a woman from said frame member;

said means for supporting said woman from said frame member comprising a first seat member secured to said frame member, said first seat member having a forward end facing toward said second end of said frame member and adapted to accommodate said woman forwardly seated therein;

and means for substantially supporting a man from said frame member;

said means for substantially supporting said man from said frame member comprising a second seat member, said second seat member having a forward end and a rear end and a longitudinal axis therebetween, said forward end of said second seat member facing toward said first end of said frame member, said second seat member being adapted to accommodate said man forwardly seated thereon, said longitudinal axis of said second seat member being substantially parallel to said longitudinal axis of said rigid frame member, and said second seat member being movable parallel to said longitudinal axis of said second seat member between a first position had a second position;

wherein said first seat member is relatively closer to said first end of said frame member than is said second seat member;

and wherein said forward end of said first seat member is in sufficiently close proximity to said forward end of said second seat member that said man and said woman can engage in intercourse with each other when said woman is forwardly seated in said first seat member and in a fixed position relative to said first seat member, and said man is forwardly seated in said second seat member and in a fixed position relative to said second seat member, and said second seat member oscillates from said first position to said second position;

and further comprising means for moving said second seat member parallel to said longitudinal axis of said second seat member between said first position and said second position while said woman is forwardly seated in said first seat, said man is forwardly seated on said second seat, and said man and said woman are engaged in intercourse with each other;

and wherein said means for moving said second seat member between said first position and said second position comprises a first motor and means for oscillating said second seat member between said first position and said second position.

2. The apparatus according to claim 1 wherein said first motor is variable speed and electrically powered.

3. The apparatus according to claim 2, further comprising an actuator member in communication with said means for moving said second seat member parallel to said longitudinal axis of said second seat member between said first position and said second position, whereby movement of said actuator member may effect a variation in the frequency of oscillation of said second seat member between said first position and said second position.

4. The apparatus according to claim 3, wherein said actuator member is adapted to be manually moved by said man while seated in said second seat member.

5. The apparatus according to claim 3 wherein said actuator member is adapted to be manually moved by said woman while seated in said first seat member.

6. The apparatus according to claim 4, wherein said second seat member is adapted to support said man while said man is seated thereon and concurrently has both feet on said floor.

7. The apparatus according to claim 6, wherein said forward end of said first seat member is less than one inch from said forward end of said second seat member when said second seat member is in said first position.

8. The apparatus according to claim 6, further comprising means for oscillating said first seat member perpendicular to said longitudinal axis of said rigid frame member.

9. The apparatus according to claim 8, wherein said means for oscillating said first seat member perpendicular to said longitudinal axis of said rigid frame member comprises a variable speed second motor.

10. The apparatus according to claim 9, further comprising:

means for pivotally connecting said first seat member to said frame member;

and means for adjusting the angle of said first seat member relative to said frame member.

* * * * *